US006294065B1

(12) United States Patent
Kawasaki et al.

(10) Patent No.: US 6,294,065 B1
(45) Date of Patent: Sep. 25, 2001

(54) METHODS OF MANUFACTURING HEATER AND CATHODE-RAY TUBE COMPRISING THE SAME

(75) Inventors: Masaki Kawasaki; Masaaki Hirota; Yoshio Hamaguchi; Takeshi Hashimoto, all of Osaka; Yoji Yamamoto, Hyogo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/203,135

(22) Filed: Dec. 1, 1998

(30) Foreign Application Priority Data

Dec. 19, 1997 (JP) ..... 9-350480

(51) Int. Cl.[7] ..... C25D 13/00
(52) U.S. Cl. ..... 204/490
(58) Field of Search ..... 204/510, 490

(56) References Cited

U.S. PATENT DOCUMENTS

| | | | | |
|---|---|---|---|---|
| 4,844,942 | | 7/1989 | Koizumi et al. . | |
| 5,138,221 | * | 8/1992 | Arato | 313/446 |
| 5,945,158 | * | 8/1999 | Djokic | 427/216 |

FOREIGN PATENT DOCUMENTS

| | | |
|---|---|---|
| 617879 | 3/1949 | (GB) . |
| 802731 | 10/1958 | (GB) . |
| 44-1775 | 1/1969 | (JP) . |
| 53-1458 | 1/1978 | (JP) . |
| 59-200798 | 11/1984 | (JP) . |
| 60-221925 | 11/1985 | (JP) . |
| 62-37842 | 2/1987 | (JP) . |
| 1-31825 | 2/1989 | (JP) . |
| 1-71032 | 3/1989 | (JP) . |
| 2-276128 | 11/1990 | (JP) . |
| 4-127022 | 4/1992 | (JP) . |
| 7-220617 | 8/1995 | (JP) . |

OTHER PUBLICATIONS

Apr. 16, 1999, Communication form European Patent Office and attached Search Report for Application No. 98123753.0–1240–.

May 11, 1999, Communication from European Patent Office and attached Search Report for Application No. 99100604.0–2208–.

* cited by examiner

*Primary Examiner*—Kishor Mayekar
(74) *Attorney, Agent, or Firm*—Merchant & Gould P.C.

(57) ABSTRACT

A method of manufacturing a heater comprises: (a) washing alumina particles with warm running-water of at least 40° C.; (b) preparing a suspension for electrodeposition by suspending the washed alumina particles in a predetermined liquid; and (c) forming an alumina insulating layer made of the alumina particles on a metal wire as a heater base metal provided inside a cathode of an electron gun by electrophoresis using the suspension for electrodeposition.

21 Claims, 9 Drawing Sheets

METHODS OF MANUFACTURING HEATER AND CATHODE-RAY TUBE COMPRISING THE SAME

FIELD OF THE INVENTION

The present invention relates to a method of manufacturing a cathode-ray tube such as a color cathode-ray tube. Particularly, the present invention relates to a method of forming an alumina insulating layer on a cathode heater for an electron gun.

BACKGROUND OF THE INVENTION

FIG. 8 shows a schematic cross-sectional view of a conventional cathode-ray tube. A cathode-ray tube 91 comprises a glass bulb 92, a neck portion 95, an electron gun 93 contained in the neck portion 95, and a phosphor screen 94.

FIG. 9 shows an enlarged cross-sectional view of an indirectly heated cathode used in an electron gun. An indirectly heated cathode 1 comprises a sleeve 6, a heater 2 inserted into the sleeve 6, a metal cover 7 located on the top of the sleeve 6, and an emissive material 8 provided on the metal cover 7. The heater 2 is formed of a metal wire 3, an alumina insulating layer 4, and a dark layer 5 having a thickness of about 3 $\mu$m. The metal wire 3 is a coiled base metal of the heater, which is made of tungsten or rhenium-tungsten. The alumina insulating layer 4 is made of alumina and the like and is formed on the surface of the metal wire 3. The dark layer 5 is made of tungsten and alumina and is formed on the alumina insulating layer 4.

The alumina insulating layer 4 is formed of an inorganic porous film. The alumina insulating layer 4 is required to have a uniform thickness and a uniform filling rate in order to prevent the occurrence of cracks caused by the concentration of thermal stress when electricity is conducted in the heater and to provide an appropriate elasticity to the heater.

Generally, electrophoresis (electrodeposition) is employed for forming an alumina insulating layer. In the case of conducting the electrodeposition of alumina powder, impurity electrolyte adhering to alumina particles is removed by dipping and washing the alumina particles in pure water. Unexamined Japanese Patent Application Tokkai Sho 59-200798 discloses that powder is washed with pure water or deionized water until the conductance of the water used for washing the powder decreases to a predetermined value or less.

As a method for obtaining a uniform filling rate of an alumina insulating layer, for example, Unexamined Japanese Patent Application Tokkai Hei 4-127022 discloses a technique for making ceramic particles adhere to the portion between adjacent coiled metal wires by conducting a pulse electrodeposition and a lamination electrodeposition successively so that the ceramic particles are distributed uniformly.

However, the technique described in the above-mentioned Tokkai Hei 4-127022 complicates the manufacturing processes. Therefore, there is a problem that the technique is not suitable for mass production.

In addition, there is the following problem in the technique of washing powders as disclosed in the above-mentioned Tokkai Sho 59-200798. That is, conventionally, in the case of washing powders, supernatant water is replaced after the first wash with a centrifugal machine. The washing and the replacement of supernatant water are repeated until a predetermined conductance is obtained from the supernatant water. When the washing according to this method was conducted using ordinary-temperature water (20° C.), it took about 24 hours. Further, since impurities present on the surfaces of or inside powders were not removed sufficiently, a lot of impurities are eluted into a suspension for electrodeposition. Therefore, the conductance of the suspension becomes high in a short period. Thus, the electrophoretic property of the alumina particles decreases. For instance, a suspension for electrodeposition having a conductance of 6.25 $\mu$S/cm had a conductance of 12.5 $\mu$S/cm after one week of elapsed time.

Generally, when the surfaces of alumina powders are in bad condition (an inert condition caused by the adhesion of impurities to the surfaces), the thickness of an alumina insulating layer is not uniform. As a result, deformation, cracks, insulation failure or the like occurs, which causes a decrease in manufacturing yield. When the surfaces of the alumina particles are in bad condition, the electrophoretic property of the alumina particles decreases. Therefore, the possibility of the formation of an uneven alumina insulating layer becomes high, even if the method of electrodeposition is adjusted. In contrast, when the surfaces of alumina particles are made to be in good condition (in an active state), the electrophoretic property of the alumina particles improves, thus obtaining a uniform alumina insulating layer with a simple method.

When the surfaces of alumina particles are in bad condition, the alteration of a suspension for electrodeposition that is used for electrodepositing alumina particles to the heater base metal (the decrease in the electrophoretic property of the alumina particles) is accelerated. Thus, it becomes difficult to manufacture heaters stably.

As described above, when the surfaces of alumina particles are in bad condition, many of the manufactured heaters have an alumina insulating layer that is not uniform in thickness and filling rate. Consequently, since the thermal stress is concentrated at the uneven parts, the occurrence of cracks or the deformation is accelerated, thus shortening the life of the heater. In addition, a lot of work is required for examining and sorting heaters with such an uneven alumina insulating layer. As a result, the productivity decreases considerably.

SUMMARY OF THE INVENTION

An object of the present invention is to provide a method of manufacturing a cathode-ray tube in which the uniformity of an alumina insulating layer and the stability of a suspension for electrodeposition are ensured and the long life of a heater and the stable production are realized.

In order to attain the object described above, the method of manufacturing a heater of the present invention comprises: a process (a) of washing alumina particles; a process (b) of preparing a suspension for electrodeposition by suspending the alumina particles in a liquid; and a process (c) of forming an alumina insulating layer by an electrophoresis using the suspension for electrodeposition. The alumina insulating layer is made of the alumina particles and covers the surface of a heater base metal. The method of manufacturing the heater of the present invention is characterized in that the alumina particles are washed with warm running-water of at least 40° C. in the process (a).

In the present invention, the surfaces of the alumina particles are purified and activated by washing the alumina particles with warm running-water. Consequently, the adhesion of electrolyte to the surfaces of the alumina particles is promoted, and the electrophoretic property of the alumina particles is therefore increased, thus obtaining an alumina insulating layer with a uniform thickness and a uniform filling rate. The effects of the present invention can be explained as follows.

Generally, when a heater base metal is coated with alumina particles by electrophoresis, a metal wire that is a heater base material is used as a cathode and a metal with low reactivity such as platinum is used as an anode. The cathode and the anode are dipped into a suspension for electrodeposition. Then, by applying voltage between the cathode and the anode, the alumina particles are gathered on the metal wire of the cathode. Thus, the metal wire is coated. In this case, it is necessary that the surfaces of the alumina particles be charged in the suspension for electrodeposition. Typically, the surfaces of the alumina particles are charged according to pH (potential of hydrogen) of the suspension or by the adhesion of electrolyte in the suspension.

When the charge is applied by adjusting the pH value, the surfaces of the alumina particles are charged positively at a pH value below 9 and are increasingly charged positively as the pH value decreases. On the other hand, the surfaces of the alumina particles are charged negatively at a pH value above 9 and are increasingly charged negatively as the pH value increases. However, when the pH in the suspension for electrodeposition is too low, the hydrogen ion concentration in the suspension becomes too high. Consequently, a hydrogen gas is generated from the cathode gathering the alumina particles, and thus the alumina insulating layer contains bubbles. As a result, a dark layer formed of a mixture of alumina and tungsten powder applied afterwards permeates into the metal wire, thus causing insulation failure or portions having a partially extremely low density and low voltage endurance in the alumina insulating layer. This has an effect on the life deterioration of the alumina insulating layer. On the contrary, when the pH is too high, the alumina particles are charged negatively and are gathered to the anode. In this case, the hydrogen ion concentration becomes high and oxygen gas is apt to be generated from the anode, thus causing the same bad condition as in the case where the pH is too low.

On the other hand, when the charge is applied by the adhesion of electrolyte, the higher the electrolyte concentration is, the more the surfaces of the alumina particles are charged. However, when the electrolyte concentration is too high, too much electrolyte is gathered on the metal wire that is a heater base metal. As a result, the impurities increase in the alumina insulating layer, which causes insulation failure.

Thus, in order to form a uniform alumina insulating layer by electrophoresis, it is desirable that the pH of the suspension for electrodeposition be not too low and not too high and the electrolyte concentration be not too high. Generally, the pH value can be controlled by the amount of the electrolyte added to the suspension. However, in order to obtain the optimum pH value of about 3 to 6, a large amount of electrolyte is necessary to be used, which is contrary to the preferable condition mentioned above.

In the manufacturing method of the present invention, the surfaces of the alumina particles are purified and activated by washing the alumina particles with warm running-water. Therefore, the adhesion of electrolyte to the surfaces of the alumina particles is promoted, and a suitable pH value (a pH of about 3 to 6) can be obtained at a lower electrolyte concentration. Additionally, a uniform alumina insulating layer can be obtained. Furthermore, by purifying and activating the surfaces of the alumina particles, the decrease in the electrophoretic property of the alumina particles in the suspension also is restrained. Consequently, stable production over a long period can be achieved.

It is preferable that the alumina particles are washed until the conductance of the waste warm running-water decreases to 4 $\mu$S/cm or less. This enables the production with a stable yield, even if the suspension for electrodeposition is used continuously.

It is preferable that the alumina particles are washed with warm running-water at 50° C. to 80° C. This can shorten the time required for the washing and also prevent the deterioration of a washing device.

Furthermore, it is preferable that the alumina particles are loosened with warm water or ordinary-temperature water before being washed with warm running-water. This can further shorten the time required for the washing.

DETAILED DESCRIPTION OF THE INVENTION

An embodiment of the present invention will be explained with reference to drawings as follows.

Figure 9:
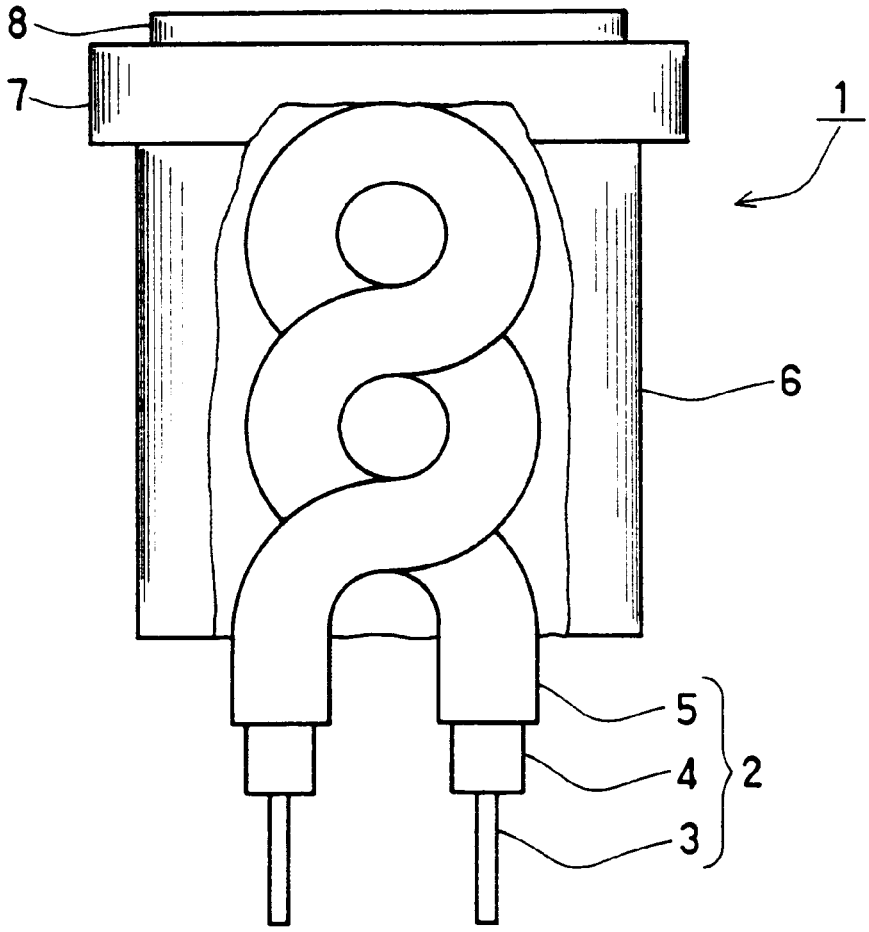
FIG. 9 (PRIOR ART)
FIG. 9 is a partial cross-sectional view of an indirectly heated cathode used in an electron gun in the conventional cathode-ray tube.

FIG. 9 shows a configuration of an indirectly heated cathode used in an electron gun of a cathode-ray tube according to the embodiment. An indirectly heated cathode 1 comprises a sleeve 6, a heater 2 inserted into the sleeve 6, a metal cover 7 located on the top of the sleeve 6, and an emissive material 8 provided on the metal cover 7. The heater 2 is formed of a metal wire 3, an alumina insulating layer 4, and a dark layer 5. The metal wire 3 is a heater base metal that is wound in a coil-shape and is made of tungsten or rhenium-tungsten. The alumina insulating layer 4 is made of alumina and is formed on the surface of the metal wire 3 by an electrophoresis. The dark layer 5 is made of tungsten and alumina and is formed on the alumina insulating layer 4.

A method of manufacturing the cathode-ray tube will be described as follows.

Figure 1:
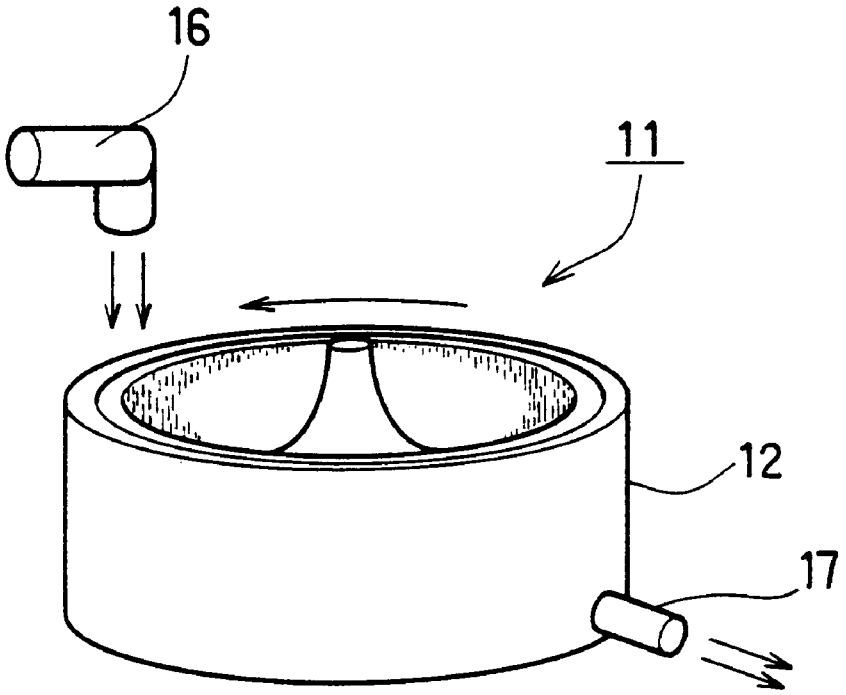
FIG. 1 is a perspective view of a washing device for washing alumina particles used for manufacturing a cathode-ray tube of an embodiment according to the present invention.
Figure 2:
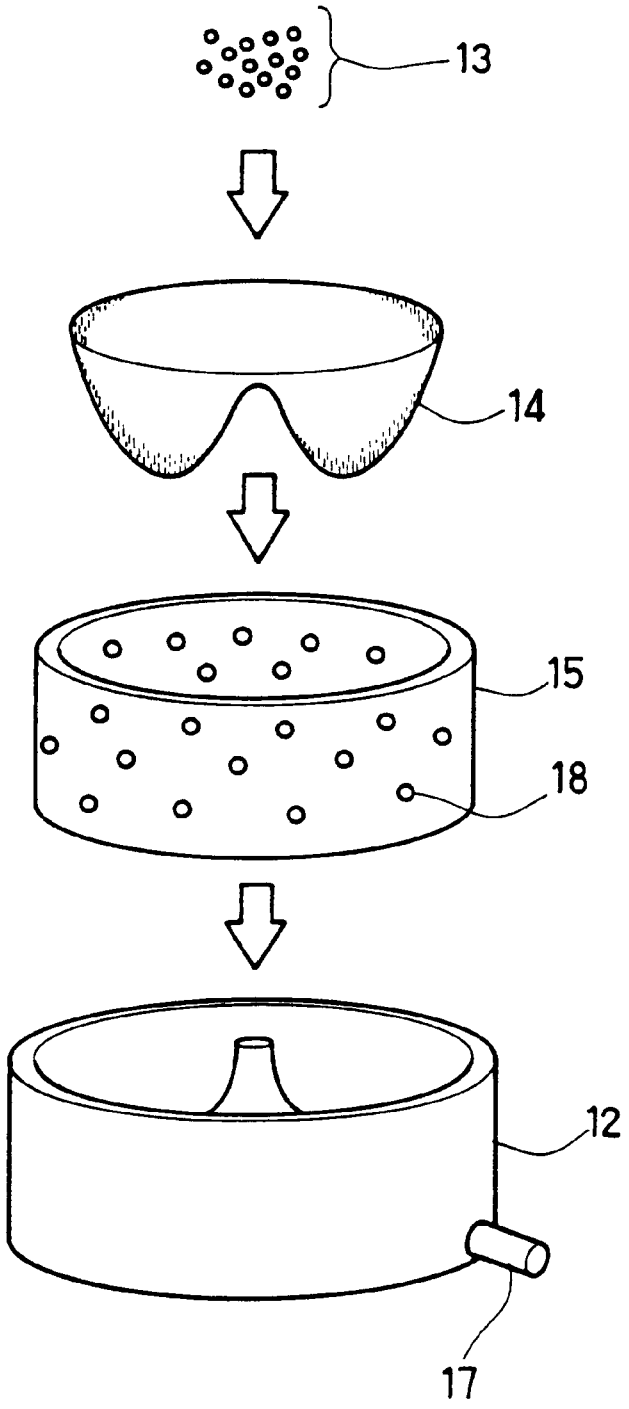
FIG. 2 is an exploded view of the washing device.

FIG. 1 shows a washing device for washing alumina particles with warm running-water. FIG. 2 shows a configuration of each part of the washing device. A washing device 11 comprises a water supply port 16, a filter cloth 14, a cylindrical drain plate 15, a centrifugal washer 12, and a scupper 17. The water supply port 16 feeds warm running-water. The filter cloth 14 retains alumina particles 13 and passes the warm running-water. The drain 15 holds the filter cloth 14 and has drain holes 18 through which the waste warm water is pushed out onto the inner wall of the centrifugal washer 12. The centrifugal washer 12 holds and rotates the drain plate 15. The waste warm water is drained through the scupper 17 from the centrifugal washer 12.

The alumina particles 13 are washed with warm running-water using the washing device 11 described above. The washing is continued until the conductance of the waste water after the washing decreases to a predetermined value or less as described later.

As a next step, a suspension for electrodeposition is prepared by suspending the washed alumina particles and predetermined electrolyte in a predetermined liquid. The metal wire 3 as an electrode and the other electrode are dipped into this suspension for electrodeposition. By applying a predetermined voltage between the metal wire 3 and the other electrode, the alumina insulating layer 4 made of alumina particles is formed on the metal wire 3 by an electrophoresis.

After this electrodeposition process, the dark layer 5 is formed on the alumina insulating layer 4, and thus the heater 2 is completed. Then, a cathode and further an electron gun are assembled by a conventional method. Thus, a cathode-ray tube is finally completed.

A concrete example of the electrodeposition process is described as follows.

In a washing device 11, 10 to 20 kg of alumina particles 13 having a purity of at least 99.7% are put into a filter cloth 14. While feeding warm water at 50 to 60° C. from a water supply port 16 at a flow rate of 16 liter/min, a centrifugal washer 12 is rotated at 1000 rpm, thus conducting centrifugal washing of the alumina particles 13. In this case, the filter cloth 14 is made of polypropylene. In the filter cloth 14, the passing flow of pure water per 1 $cm^2$ is 5 ml/min. This centrifugal washing is continued until the conductance of the waste water drained from a scupper 17 decreases to 4 $\mu$S/cm or less. After the conductance of the waste water decreases to 4 $\mu$S/cm or less, the alumina particles 13 are taken out and are dried for 16 hours at 120 to 150° C.

Next, 1 kg of the washed alumina particles, 2400 ml of methyl alcohol, 500 ml of a solution including 10 wt. % of PVAc (polyvinyl acetate), and 100 ml of a rosin solution including 10 wt. % of rosin are mixed. Further, a suitable amount of a copper nitrate solution including 9 wt. % of copper nitrate is added as electrolyte. Thus, a suspension for electrodeposition is prepared.

This suspension for electrodeposition is put into a coating bath. The metal wire 3 as a cathode and a platinum electrode as an anode are dipped into the suspension for electrodeposition. A voltage of 70 to 120 V is applied between the cathode and the anode for 2 to 10 seconds, thus electrodepositing the alumina insulating layer 4 with a thickness of 60 to 150 $\mu$m on a heater.

In this example, the copper nitrate solution is used as an electrolyte. However, the same effect can be obtained when another electrolyte such as an aluminum nitrate solution or an aluminum chloride solution is used.

Next, an effect and a suitable manufacturing condition of the present invention will be explained.

Figure 3:
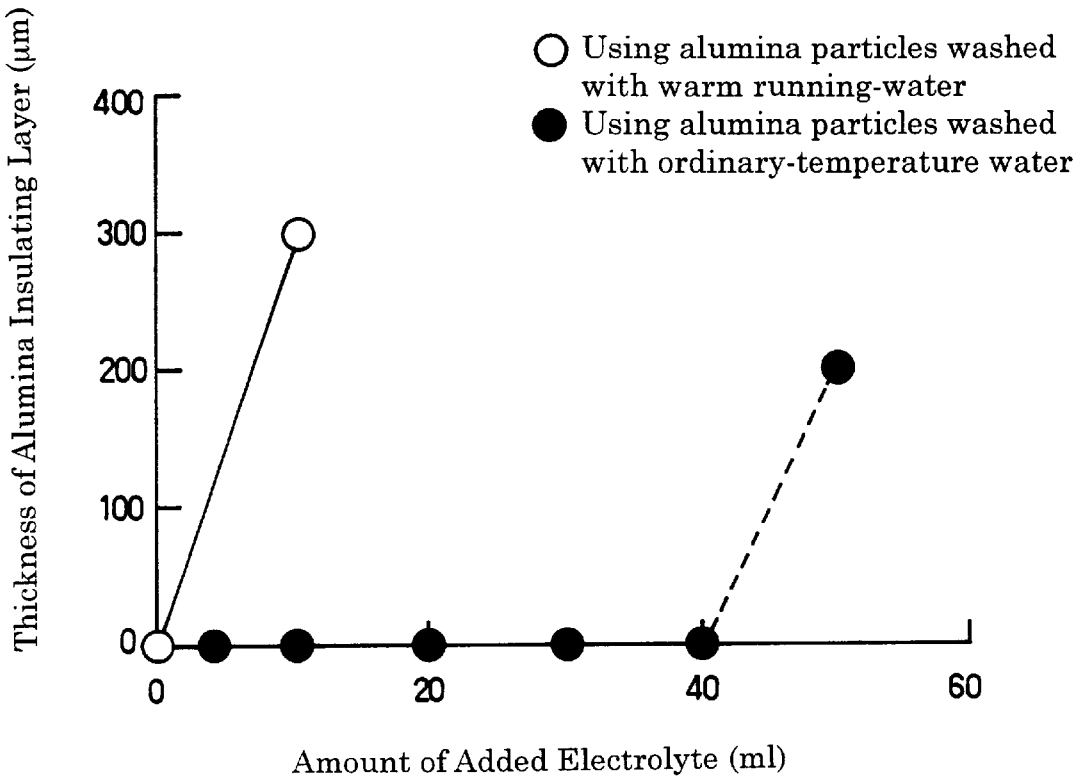
FIG. 3 is a graph showing the relationship between the amount of electrolyte added to a suspension for electrodeposition and the thickness of an alumina insulating layer by comparing the case where alumina particles are washed with warm running-water using the washing device with the case where the alumina particles are washed with ordinary-temperature water as in the prior art.

FIG. 3 shows the relationship between the amount of electrolyte added to a suspension for electrodeposition and the thickness of an alumina insulating layer formed thereby. The relationship shown in FIG. 3 is an example under the following conditions. A suspension for electrodeposition is prepared by washing alumina particles under the same conditions as in the example described above. A voltage of 100V is applied between a cathode and an anode for 10 seconds for conducting electrodeposition.

In the case where the alumina particles were washed with warm running-water (shown with ○ in FIG. 3), the alumina particles started to show the electrophoretic property when 10 ml of a copper nitrate solution as electrolyte was added, and then an alumina insulating layer was formed. On the contrary, in the case where the alumina particles were not washed with warm running-water (shown with ●), the alumina particles did not show the electrophoretic property when 40 ml of the electrolyte was added. It can be seen that the alumina particles did not show the electrophoretic property until 50 ml of the electrolyte was added. The case where the alumina particles were not washed with warm running-water means the case where the alumina particles were washed by the processes of: dipping the alumina particles into pure water (or deionized water) at an ordinary temperature (20° C.); conducting centrifuging; renewing the ordinary-temperature water; conducting centrifuging again; and further renewing the ordinary-temperature water. When the alumina particles were washed with warm running-water, the alumina insulating layer 4 had a thickness of 300 $\mu$m. On the other hand, when the alumina particles were not washed with warm running-water, the alumina insulating layer had a thickness of 200 $\mu$m.

Thus, compared to the case where the alumina particles were not washed with warm running-water, when the alumina particles are washed with warm running-water, the higher electrophoretic property can be obtained by adding a lower amount of electrolyte. It is preferable that the suspension for electrodeposition of the present embodiment is adjusted so as to have a conductance of 10–20 $\mu$S/cm depending on the electrolyte. In the case of using the suspension for electrodeposition of the present embodiment, at least 10 ml of a copper nitrate solution including 9 wt. % of copper nitrate should be added for 1 kg of washed alumina particles. In other words, in the suspension for electrodeposition using alumina particles washed with warm running-water, it is preferable that the composition ratios of the alumina particles and the electrolyte are 25–35 wt. % and 0.05–0.15 wt. % respectively.

Figure 4:
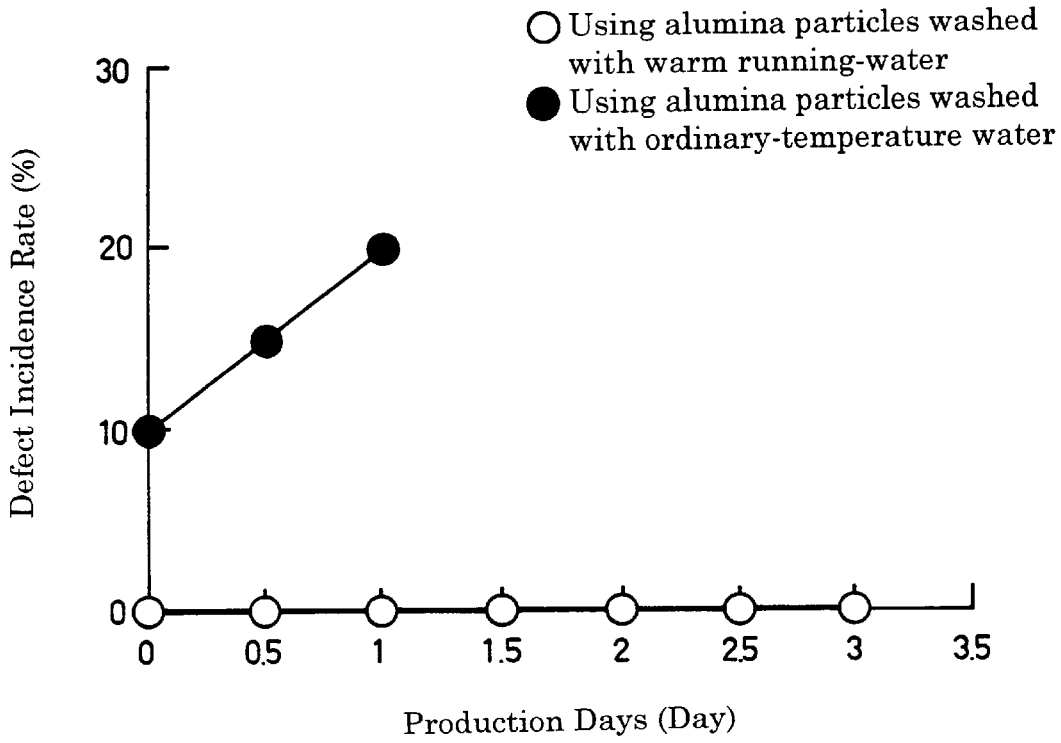
FIG. 4 is a graph showing the relationship between the period of using a suspension for electrodeposition and the defect incidence rate by comparing the case where alumina particles are washed with warm running-water using the washing device with the case where the alumina particles are washed with ordinary-temperature water as in the prior art.
Figure 7A:
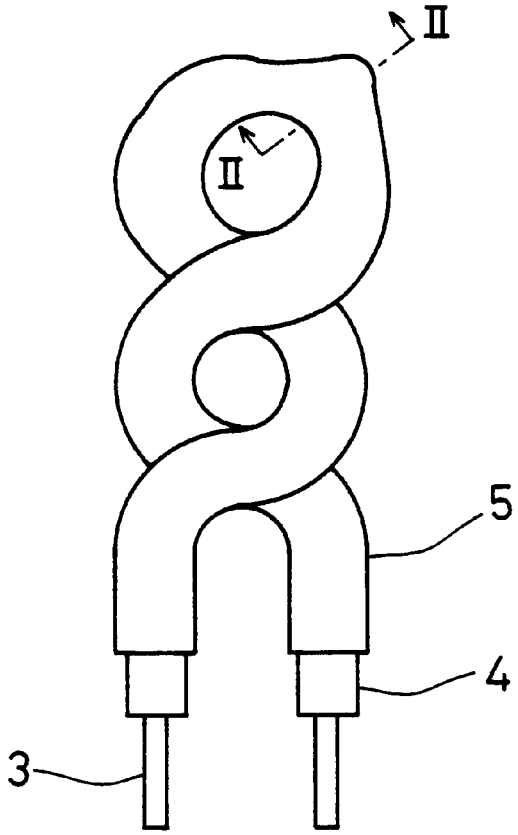
FIG. 7A is a side view of a heater with an alumina insulating layer having a bad appearance.
Figure 7B:
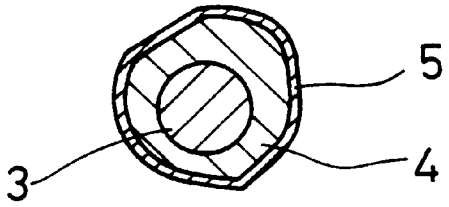
FIG. 7B is a cross-sectional view taken on line II—II of FIG. 7A.
Figure 8:
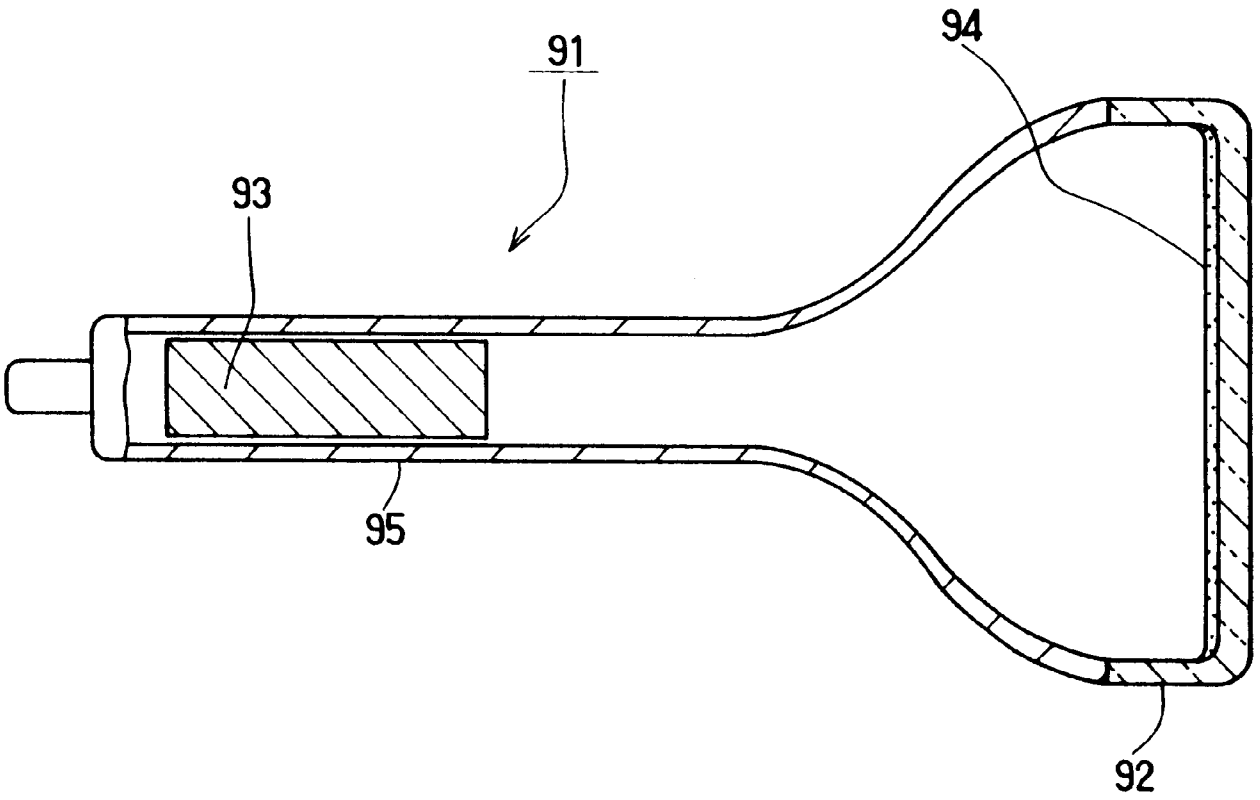
FIG. 8 (PRIOR ART)
FIG. 8 is a sectional side view of a conventional cathode-ray tube.

FIG. 4 shows the relationship between the production days and the defect incidence rate in formed alumina insulating layers in the case of using a suspension for electrodeposition continuously in a mass-production process, which shows the stability of the suspension for electrodeposition. In this case, the term "defect" indicates such a condition that unevenness is found on an alumina insulating layer in observing the appearance of a heater, for example, as shown in FIGS. 7A and 7B.

Figure 6A:
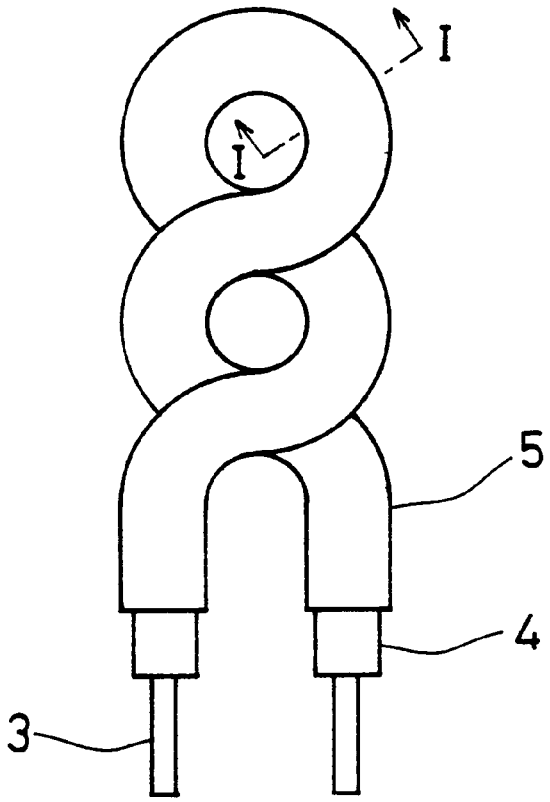
FIG. 6A is a side view of a heater with an alumina insulating layer having an excellent appearance.
Figure 6B:
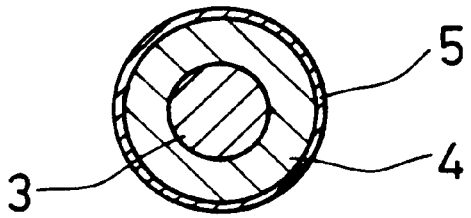
FIG. 6B is a cross-sectional view taken on line I—I of FIG. 6A.

When employing a suspension for electrodeposition using alumina particles washed with warm running-water (shown with ○ in FIG. 4), at least 99% of the formed alumina insulating layers 4 had excellent appearances. That is, unevenness was not found on the alumina insulating layer 4 as shown in FIGS. 6A and 6B. The alumina insulating layer 4 had a uniform thickness. In addition, the same alumina insulating layers 4 were formed when using this suspension for at least 3 days.

On the contrary, when employing a suspension for electrodeposition using alumina particles that were not washed with warm running-water (shown with ●), the defect incidence rate was 10% or more from the beginning. Additionally, the defective fraction increased gradually within one day. Therefore, it was necessary to change the suspension for electrodeposition frequently, thus decreasing the manufacturing yield.

Figure 5:
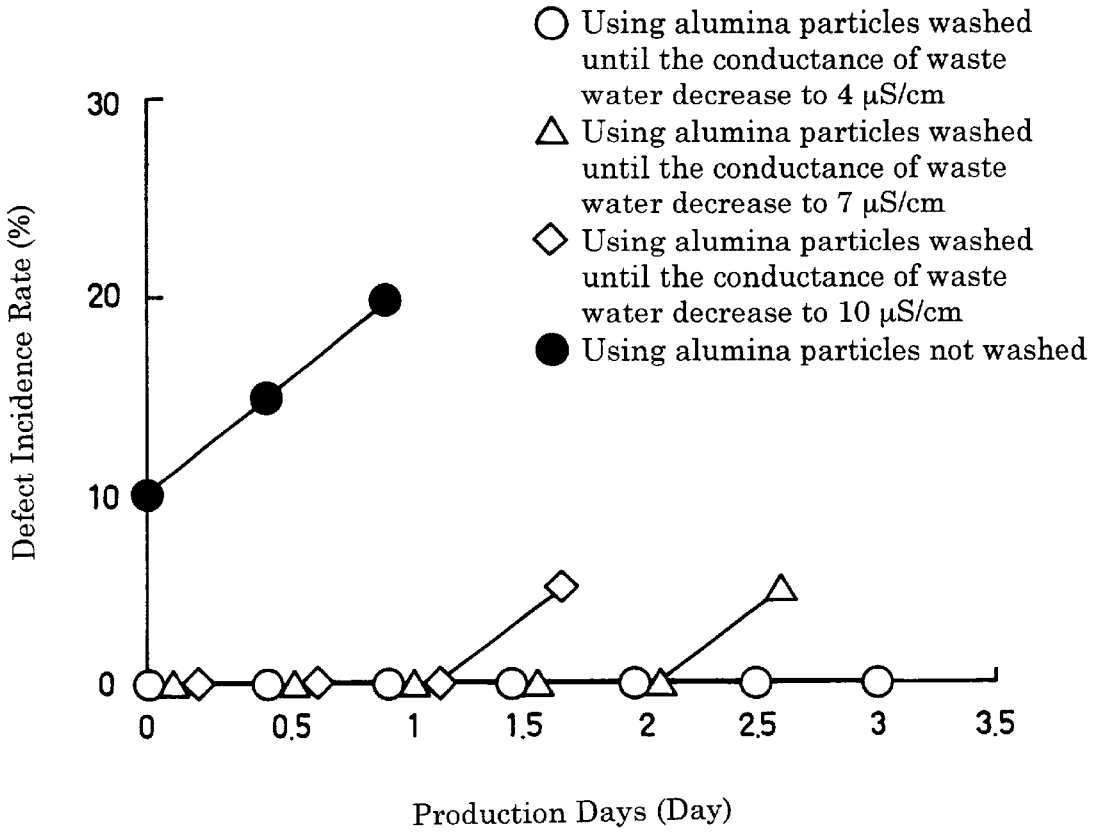
FIG. 5 also is a graph showing the relationship between the period of using a suspension for electrodeposition and the defect incidence rate by comparing the case where alumina particles are washed with warm running-water using the washing device with the case where the alumina particles are washed with ordinary-temperature water as in the prior art.

FIG. 5 shows the relationship between the production days and the defect incidence rate in the case of using a suspension for electrodeposition continuously in a mass-production process as in FIG. 4. FIG. 5 shows the effect on the defect incidence rate by the conductance of the waste water at the time of finishing the washing of the alumina particles.

When alumina particles were not washed with warm running-water (shown with ● in FIG. 5), the defect incidence rate was at least 20% after a suspension for electrodeposition was used for one day. Therefore, the suspension could not be used further in the mass production. On the contrary, when alumina particles were washed until the conductance of the waste water decreased to 10 μS/cm (shown with ◇), little defects occurred, even after the suspension for electrodeposition prepared using the alumina particles was used for one day. When alumina particles were washed until the conductance of the waste water decreased to 7 μS/cm (shown with Δ), little defect occurred, even after the suspension was used continuously for about two days. When alumina particles were washed until the conductance of the waste water decreased to 4 μS/cm (shown with ○), little defect occurred, even after the suspension was used continuously for about three days.

Consequently, in view of the stability of the suspension for electrodeposition, it is preferable that the washing is continued until the conductance of waste water decreases as low as possible when alumina particles are washed with warm running-water. However, when trying to obtain a low conductance, the washing time becomes longer accordingly. As a result, the productivity is decreased. Therefore, it is preferable to wash alumina particles in a mass-production process until the conductance decreases to about 4 μS/cm.

Using pure water or deionized water in the above-mentioned washing device 11, the relationship between the water temperature and the washing time was examined. As a result, in order to make waste water have a conductance of 4 μS/cm or less, it took 8 to 10 hours at 20° C. or 5 to 7 hours at 30° C. When alumina particles were washed with warm running-water at 40° C., the washing was completed about in 4 hours. Further, when the warm running-water at least at 50° C. was used, it took about 2 hours or less. On the other hand, when the temperature of the warm running-water is too high, the deterioration of the washing device is accelerated. Therefore, it is preferable that the warm running-water used for the washing has a temperature of at least 40° C. When considering the time required for the washing and the deterioration of the device, the optimum temperature of the warm running-water is 50 to 80° C. The optimum temperature is considered herein with respect to atmospheric pressure.

It is preferable that the alumina particles are put into warm water or ordinary-temperature water to be loosened before being washed with warm running-water, thus obtaining a dispersing liquid. When this dispersing liquid is washed with warm running-water, the washing time can be shortened. For example, when a dispersing liquid prepared by dispersing alumina particles in water is supplied to a washer, the time required for obtaining waste water with a conductance of 4 μS/cm is shortened to about 30 to 60 minutes.

As described above, according to the present invention, surfaces of alumina particles are purified and activated by washing the alumina particles with warm running-water. Consequently, the adhesion of electrolyte to the surfaces of the alumina particles are improved, and the electrophoretic property of the alumina particles can be increased, thus ensuring the uniformity of an alumina insulating layer and the stability of a suspension for electrodeposition. Thus, the long-life heater and the stable production over a long period can be achieved.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of manufacturing a heater provided inside a cathode of an electron gun of a cathode-ray tube, the method comprising:

(a) washing alumina particles with-warm running-water of at least 40° C.;

(b) preparing a suspension by suspending the washed alumina particles in a liquid; and (c) forming an alumina insulating layer made of the alumina particles on a surface of a heater base metal by an electrophoresis using the suspension.

2. The method of manufacturing a heater according to claim 1, wherein the alumina particles are washed until the conductance of the waste water with which the alumina particles have been washed decreases to 4 μS/cm or less in the process (a).

3. The method of manufacturing a heater according to claim 2, wherein the warm running water has a temperature of 50 to 80° C.

4. The method of manufacturing a heater according to claim 2, wherein the method further comprises a step of loosening the alumina particles in water before the washing step (a).

5. The method of manufacturing a heater according to claim 2, wherein the suspension has a pH value in a range of 3 to 6.

6. The method of manufacturing a heater according to claim 2, wherein a voltage of 70 to 120 V is applied between electrodes for electrodeposition for 2 to 10 seconds in the electrophoresis step (c).

7. The method of manufacturing a heater according to claim 2, wherein the alumina insulating layer has a thickness of 60 to 150 μm after the electrophoresis step (c).

8. The method of manufacturing a heater according to claim 1, wherein the warm running water has a temperature of 50 to 80° C.

9. The method of manufacturing a heater according to claim 8, wherein the method further comprises a process for loosening the alumina particles in water before the washing step (a).

10. The method of manufacturing a heater according to claim 1, wherein the method further comprises a process for loosening the alumina particles in water before the washing step (a).

11. The method of manufacturing a heater according to claim 10, wherein the suspension has a pH value in a range of 3 to 6.

12. The method of manufacturing a heater according to claim 10, wherein a voltage of 70 to 120 V is applied between electrodes for electrodeposition for 2–10 seconds in the electrophoresis step (c).

13. The method of manufacturing a heater according to claim 10, wherein the alumina insulating layer has a thickness of 60 to 150 $\mu$m after the electrophoresis step (c).

14. The method of manufacturing a heater according to claim 1, wherein a centrifugal washer is used for the washing step (a).

15. The method of manufacturing a heater according to claim 1, wherein the suspension has a pH value in a range of 3 to 6.

16. The method of manufacturing a heater according to claim 15, wherein a voltage of 70 to 120 V is applied between electrodes for electrodeposition for 2–10 seconds in the electrophoresis step (c).

17. The method of manufacturing a heater according to claim 15, wherein the alumina insulating layer has a thickness of 60 to 150 $\mu$m after the electrophoresis step (c).

18. The method of manufacturing a heater according to claim 1, wherein a voltage of 70 to 120 V is applied between electrodes for electrodeposition for 2–10 seconds in the electrophoresis step (c).

19. The method of manufacturing a heater tube according to claim 18, wherein the alumina insulating layer has a thickness of 60 to 150 $\mu$m after the electrophoresis step (c).

20. The method of manufacturing a heater according to claim 1, wherein the alumina insulating layer has a thickness of 60 to 150 $\mu$m after the electrophoresis step (c).

21. A method of manufacturing a cathode-ray tube comprising:

(a) washing alumina particles with warm running-water of at least 40° C.;

(b) preparing a suspension by suspending the washed alumina particles in a liquid;

(c) forming an alumina insulating layer that is made of the alumina particles and covers a surface of a heater base metal by an electrophoresis using the suspension;

(d) forming a dark layer on the alumina insulating layer;

(e) assembling a cathode using a heater formed in the steps (a)–(d);

(f) assembling an electron gun using the cathode; and (g) assembling a cathode-ray tube using the electron gun.

* * * * *